US005774933A

United States Patent [19]

Jannicelli, Jr.

[11] Patent Number: 5,774,933

[45] Date of Patent: Jul. 7, 1998

[54] ATTACHMENT DEVICE FOR A CLEANING APPARATUS

[76] Inventor: Edward Jannicelli, Jr., 1785 Rose Blvd., Nashville, N.C. 27856

[21] Appl. No.: 676,439

[22] Filed: Jul. 8, 1996

[51] Int. Cl.[6] ..... A47L 5/28

[52] U.S. Cl. ..... 15/398; 15/344; 15/405

[58] Field of Search ..... 15/344, 398, 405, 15/400

[56] References Cited

U.S. PATENT DOCUMENTS

| | | | |
|---|---|---|---|
| 3,999,243 | 12/1976 | La Pour | 15/405 X |
| 4,459,720 | 7/1984 | Abif et al. | 15/398 |
| 4,945,604 | 8/1990 | Miner et al. | 15/405 X |
| 4,956,892 | 9/1990 | Fawkes | 15/398 X |
| 5,054,159 | 10/1991 | Richardson | 15/398 X |

*Primary Examiner*—Chris K. Moore

[57] ABSTRACT

An attachment device for a cleaning apparatus including an attachment comprised of a head portion. The head portion has and upper surface and a lower surface. A clamp assembly is comprised of a pair of clamping members dimensioned for coupling with a cleaning apparatus. Each clamping member has a tab extending upwardly from upper ends thereof. Each tab has a threaded aperture therethrough. A thumbscrew extends through the threaded apertures of the tabs for securement of the pair of clamping members to the cleaning apparatus. The clamp assembly is coupleable to the attachment.

1 Claim, 4 Drawing Sheets

Fig. 5
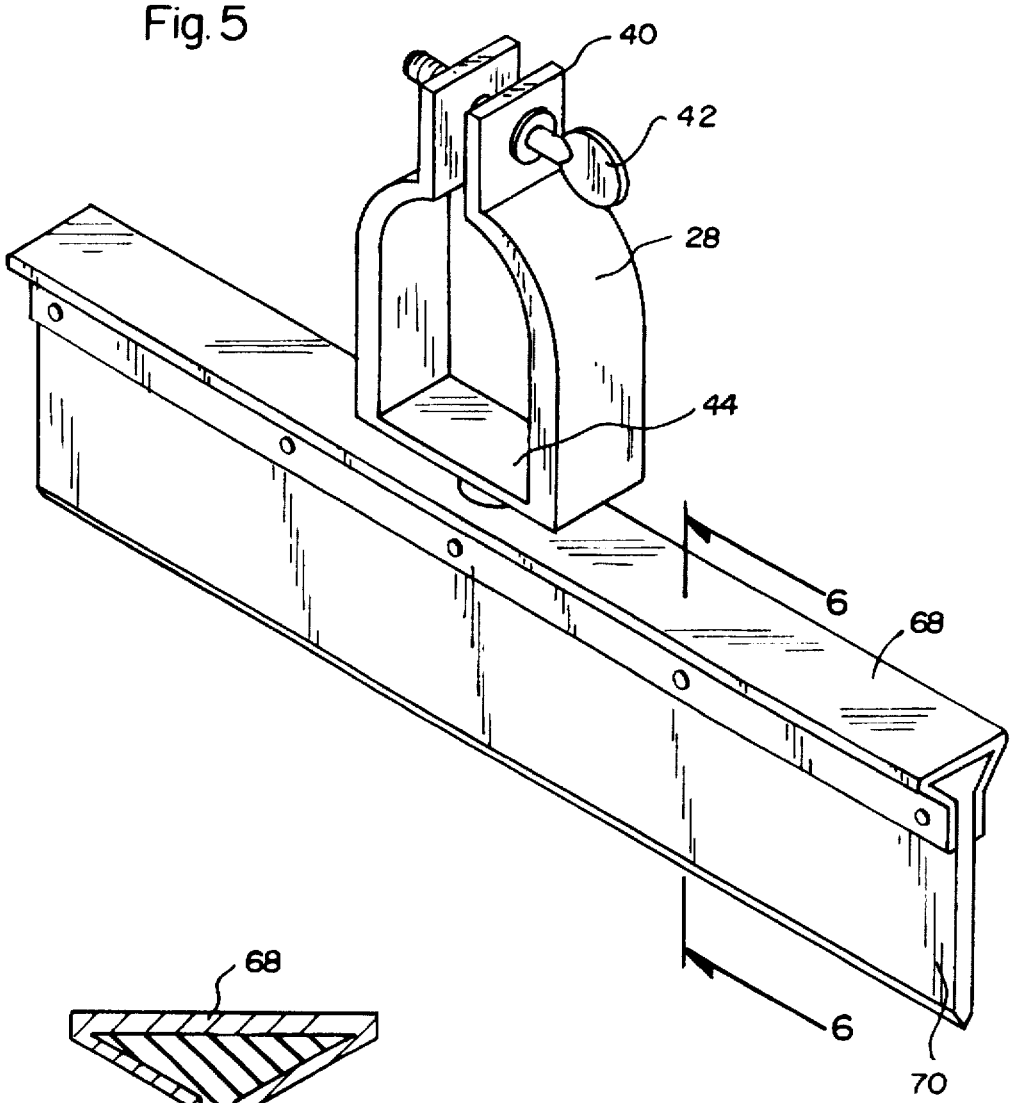
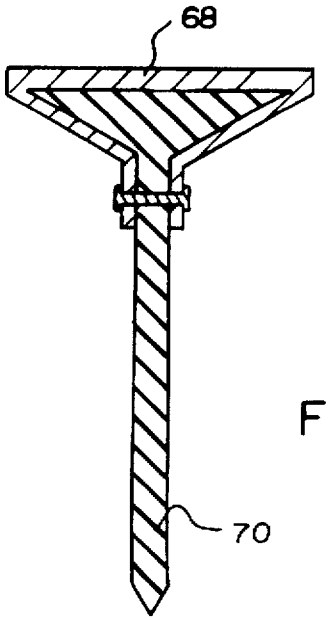
Fig. 6

ATTACHMENT DEVICE FOR A CLEANING APPARATUS

BACKGROUND OF THE INVENTION

1. Field of the Invention

The present invention relates to an attachment device for a cleaning apparatus and more particularly pertains to attaching to a cleaning apparatus to provide improved cleaning capabilities with an attachment device for a cleaning apparatus.

2. Description of the Prior Art

The use of cleaners and blowers is known in the prior art. More specifically, cleaners and blowers heretofore devised and utilized for the purpose of cleaning and area of debris are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,817,235 to Doxey et al. discloses a pneumatic pavement cleaning apparatus.

U.S. Pat. No. 4,513,471 to Rahn discloses a sweeper blower device.

U.S. Pat. No. 5,414,889 to Sartori discloses a broom with position-maintaining multi-angle handle interconnector.

U.S. Pat. No. 5,222,275 to Baker et al. discloses a blower vacuum.

U.S. Pat. No. 5,272,858 to Bonis discloses an attachment for leaf blowers.

While these devices fulfill their respective, particular objective and requirements, the aforementioned patents do not describe an attachment device for a cleaning apparatus for attaching to a cleaning apparatus to provide improved cleaning capabilities.

In this respect, the attachment device for a cleaning apparatus according to the present invention substantially departs from the conventional concepts and designs of the prior art, and in doing so provides an apparatus primarily developed for the purpose of attaching to a cleaning apparatus to provide improved cleaning capabilities.

Therefore, it can be appreciated that there exists a continuing need for new and improved attachment device for a cleaning apparatus which can be used for attaching to a cleaning apparatus to provide improved cleaning capabilities. In this regard, the present invention substantially fulfills this need.

SUMMARY OF THE INVENTION

In the view of the foregoing disadvantages inherent in the known types of cleaners and blowers now present in the prior art, the present invention provides an improved attachment device for a cleaning apparatus. As such, the general purpose of the present invention, which will be described subsequently in greater detail, is to provide a new and improved attachment device for a cleaning apparatus and method which has all the advantages of the prior art and none of the disadvantages.

To attain this, the present invention essentially comprises a leaf blower having a motor housing. The motor housing has a bag extending from a rear portion thereof. The motor housing has an elongated tube extending from a front portion thereof. The elongated tube has an open free end. The device includes a broom attachment comprised of a head portion. The head portion has and upper surface and a lower surface. A plurality of bristles extend downwardly from the lower surface. The device includes a clamp assembly comprised of a pair of clamping members dimensioned for coupling with the elongated tube of the leaf blower inwardly of the open free end thereof. Each clamping member has a tab extending upwardly from upper ends thereof. Each tab has a threaded aperture therethrough. A thumbscrew extends through the threaded apertures of the tabs for securement of the pair of clamping members to the elongated tube. Lower ends of the pair of clamping members have a cross member extending therebetween. The cross member had a downwardly extending central portion. The device includes a pivot assembly comprised of a plate member secured to the upper surface of the head portion of the broom attachment. The plate member has an upwardly extending central portion. A T-shaped stem extends upwardly from the upwardly extending central portion to rotatably couple with the downwardly extending central portion of the cross member of the clamp assembly. The upwardly extending central portion has a plurality of sockets formed in an upper surface thereof surrounding a shaft of the T-shaped stem. A plurality of ball bearings are positioned within the plurality of sockets to facilitate rotation of the pivot assembly relative to the clamp assembly.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved attachment device for a cleaning apparatus which has all the advantages of the prior art cleaners and blowers and none of the disadvantages.

It is another object of the present invention to provide a new and improved attachment device for a cleaning apparatus which may be easily and efficiently manufactured and marketed.

It is a further object of the present invention to provide a new and improved attachment device for a cleaning apparatus which is of durable and reliable construction.

An even further object of the present invention is to provide a new and improved attachment device for a cleaning apparatus which is susceptible of a low cost of manufacture with regard to both materials and labor, and which accordingly is then susceptible of low prices of sale to the consuming public, thereby making such an attachment device for a cleaning apparatus economically available to the buying public.

Still yet another object of the present invention is to provide a new and improved attachment device for a cleaning apparatus which provides in the apparatuses and methods of the prior art some of the advantages thereof, while simultaneously overcoming some of the disadvantages normally associated therewith.

Even still another object of the present invention is to provide a new and improved attachment device for a cleaning apparatus for attaching to a cleaning apparatus to provide improved cleaning capabilities.

Lastly, it is an object of the present invention to provide a new and improved attachment device for a cleaning apparatus including an attachment comprised of a head portion. The head portion has and upper surface and a lower surface. A clamp assembly is comprised of a pair of clamping members dimensioned for coupling with a cleaning apparatus. Each clamping member has a tab extending upwardly from upper ends thereof. Each tab has a threaded aperture therethrough. A thumbscrew extends through the threaded apertures of the tabs for securement of the pair of clamping members to the cleaning apparatus. The clamp assembly is coupleable to the attachment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of a second embodiment of the present invention.

FIG. 6 is a cross-sectional view as taken along line 6—6 of FIG. 5.

The same reference numerals refer to the same parts through the various Figures.

DESCRIPTION OF THE PREFERRED EMBODIMENT

Figure 1:
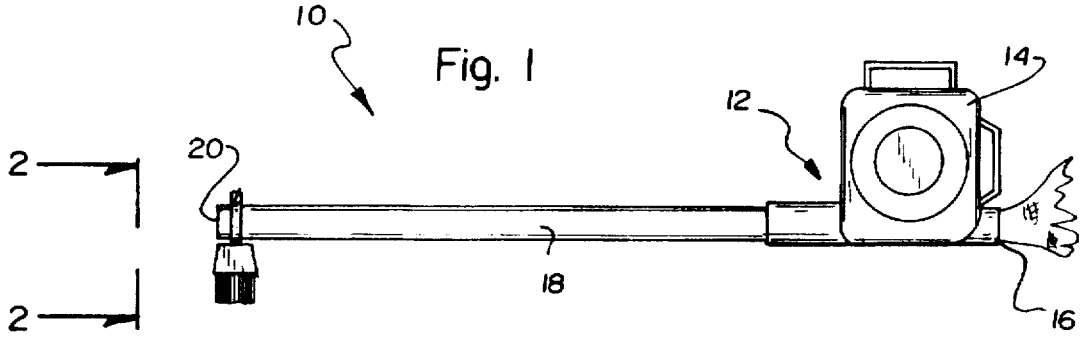
FIG. 1 is a perspective view of the preferred embodiment of the attachment device for a cleaning apparatus constructed in accordance with the principles of the present invention.
Figure 2:
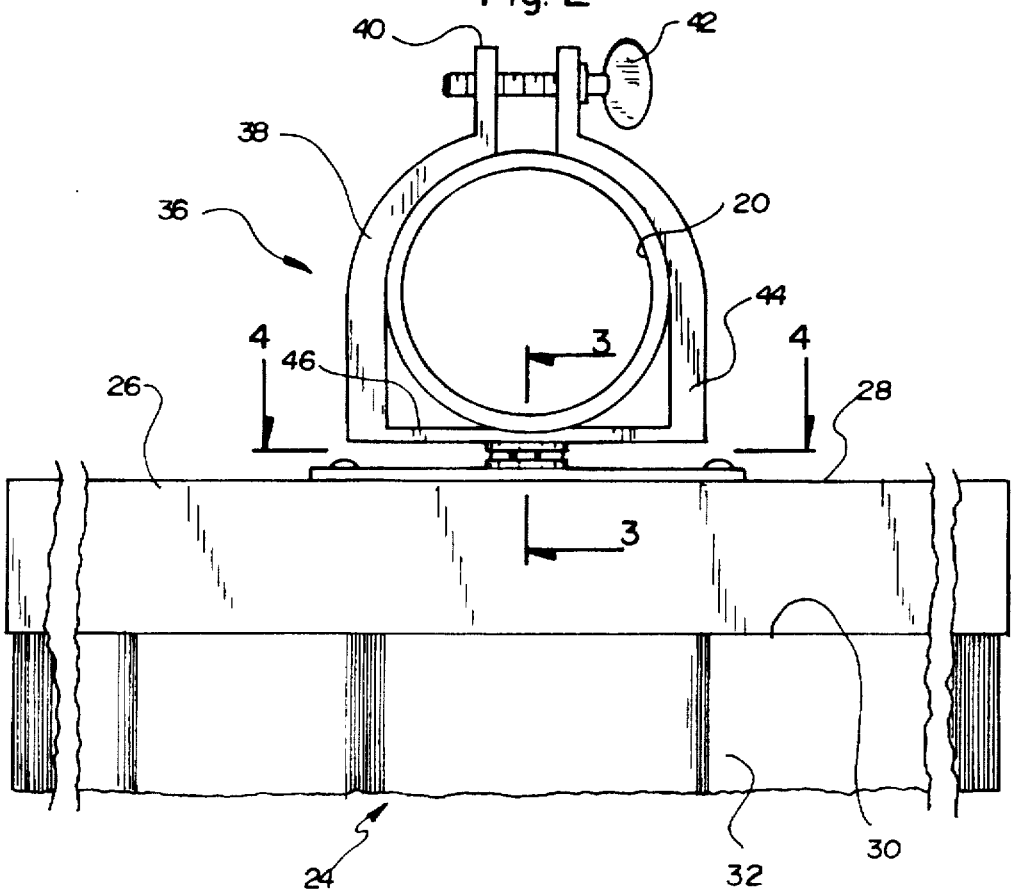
FIG. 2 is a front elevation view of the present invention.
Figure 3:
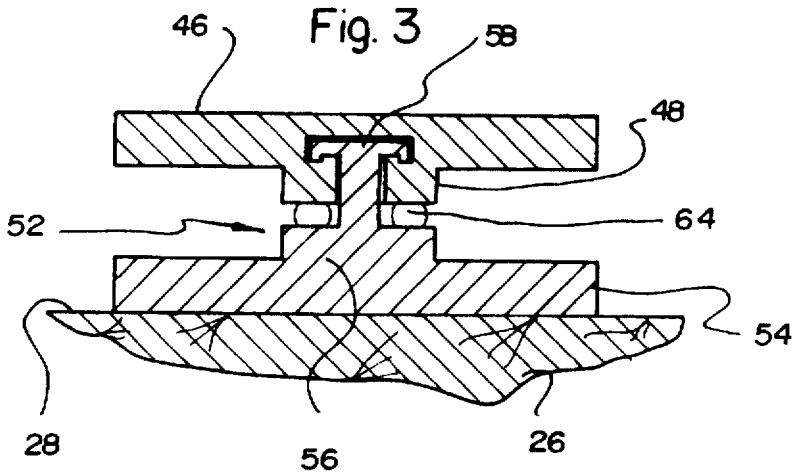
FIG. 3 is a cross-sectional view as taken along line 3—3 of FIG. 2.
Figure 4:
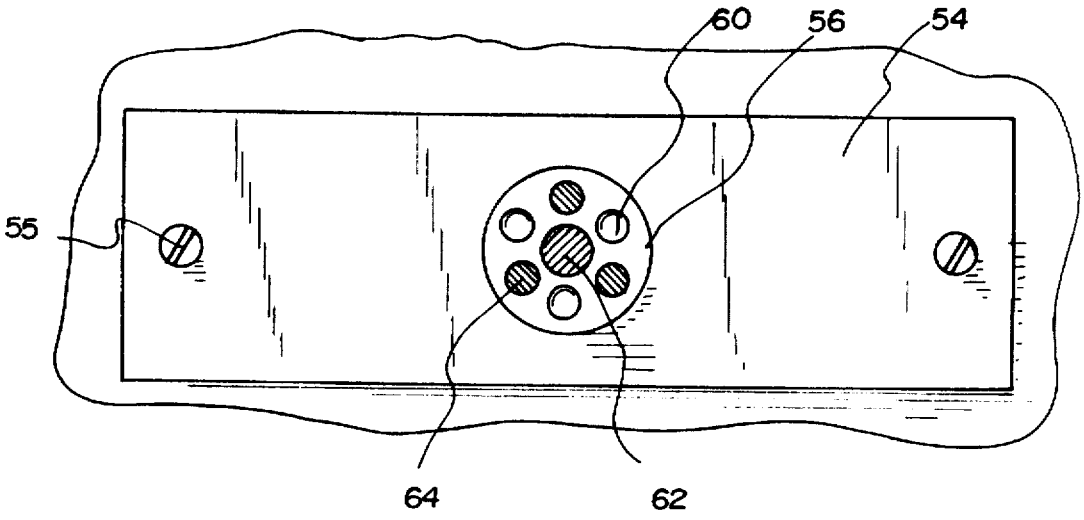
FIG. 4 is a cross-sectional view as taken along line 4—4 of FIG. 2.

With reference now to the drawings, and in particular, to FIGS. 1–6 thereof, the preferred embodiment of the new and improved attachment device for a cleaning apparatus embodying the principles and concepts of the present invention and generally designated by the reference number 10 will be described.

Specifically, it will be noted in the various Figures that the device relates to a attachment device for a cleaning apparatus for attaching to a cleaning apparatus to provide improved cleaning capabilities. In its broadest context, the device consists of a leaf blower, a broom attachment, a clamp assembly and a pivot assembly. Such components are individually configured and correlated with respect to each other so as to attain the desired objective.

The device 10 includes a leaf blower 12 having a motor housing 14. The motor housing 14 has a bag 16 extending from a rear portion thereof. The motor housing 14 has an elongated tube 18 extending from a front portion thereof. The elongated tube 18 has an open free end 20. The leaf blower 12 is of the type known in the art.

The device 10 includes a broom attachment 24 comprised of a head portion 26. The head portion 26 has and upper surface 28 and a lower surface 30. A plurality of bristles 32 extend downwardly from the lower surface 30. The materials used to comprise the plurality of bristles 32 are of the type known used in the various types of scrub brushes known in the art.

Next, the device 10 includes a clamp assembly 36 comprised of a pair of clamping members 38 dimensioned for coupling with the elongated tube 18 of the leaf blower 12 inwardly of the open free end 20 thereof. Each clamping member 38 has a tab 40 extending upwardly from upper ends thereof. Each tab 40 has a threaded aperture therethrough. A thumbscrew 42 extends through the threaded apertures of the tabs 40 for securement of the pair of clamping members 38 to the elongated tube 18. The clamping members 38 are slightly flexible to allow the clamp assembly 36 to be positioned on the elongated tube 18. The thumb screw 42 will secure the clamp assembly in place on the elongated tube 18 by pinching in on the clamping members 38 around the elongated tube 18. Alternately, loosening of the thumb screw 42 will allow for the clamping assembly 36 to be removed from the elongated tube 18. Lower ends 44 of the pair of clamping members 38 have a cross member 46 extending therebetween. The cross member 46 has a downwardly extending central portion 48.

Lastly, the device 10 includes a pivot assembly 52 comprised of a plate member 54 secured to the upper surface 28 of the head portion 26 of the broom attachment 24. The plate member 54 is secured to the head portion 26 by a pair of screws 55 extending through the plate member 54 and into the head portion 26. Alternately, the device 10 can be incorporated into an existing broom or other cleaning apparatus. The plate member 54 has an upwardly extending central portion 56. A T-shaped stem 58 extends upwardly from the upwardly extending central portion 56 to rotatably couple with the downwardly extending central portion 48 of the cross member 46 of the clamp assembly 36. The upwardly extending central portion 56 has a plurality of sockets 60 formed in an upper surface thereof surrounding a shaft 62 of the T-shaped stem 58. A plurality of ball bearings 64 are positioned within the plurality of sockets 60 to facilitate rotation of the pivot assembly 52 relative to the clamp assembly 36.

A second embodiment of the present invention is shown in FIGS. 5 and 6 and includes substantially all of the components of the present invention wherein the attachment is a squeegee and the cleaning apparatus is a wet/dry vacuum. The squeegee is comprised of an elongated head portion 68. The elongated head portion 68 has an elongated planar rubber strip 70 extending downwardly therefrom. The squeegee is used in association with the wet/dry vacuum to maneuver water in hard to reach places to be sucked up by the vacuum. The squeegee incorporates the clamp assembly 36 and the pivot assembly 52 to couple the squeegee with a hose or tube of the vacuum.

Figure 7:
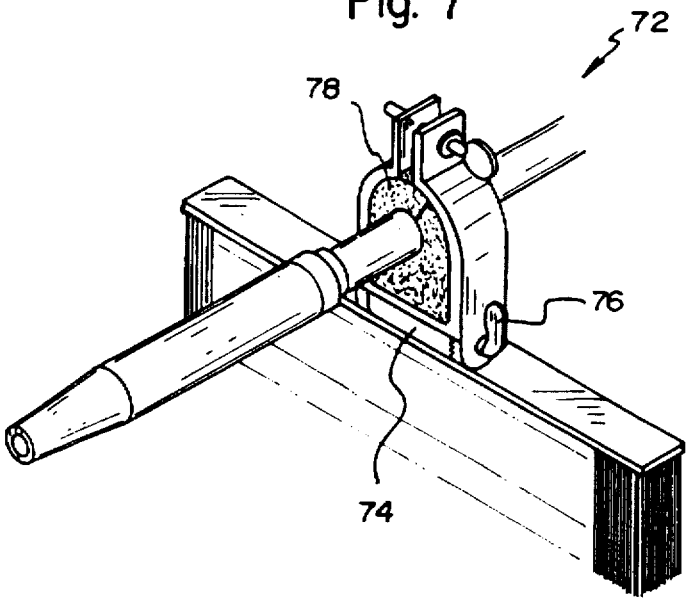
FIG. 7 is a perspective view of a third emboidment of the present invention.
Figure 8:
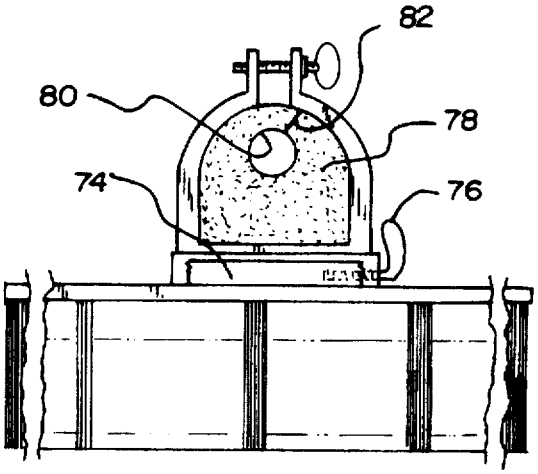
FIG. 8 is a front elevational view of the attachment device of FIG. 7.

A third embodiment 72, as shown in FIGS. 7 & 8, includes a hinge assembly 74 rotatably coupled with the downwardly extending central portion of the cross member of the clamp assembly in lieu of the pivot assembly. The hinge assembly is further secured to the upper surface of the head portion of the attachment. In addition, the hinge assembly comprises a spring-biased locking mechanism 76. In use, the locking mechanism has a first orientation for allowing free movement of the hinge assembly and further a second orientation for precluding movement of the hinge assembly thus securing the attachment in a selected orientation.

As an option, any one of the embodiments may include an elastomeric insert 78 situatable between the clamping members of the clamp. The insert has a cut out 80 centrally formed therein. A slit 82 is formed between the cut out and a periphery of the insert. As such, a tool with a small diameter may be situated within the cut out via the slit whereat the insert may be inserted between the clamping members. The insert thus allows the utilization of a tool with a small diameter such as a garden hose, garden tool, or the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An attachment device for a cleaning apparatus for attaching to a cleaning apparatus to provide improved cleaning capabilities comprising, in combination:

a leaf blower having a motor housing, the motor housing having a bag extending from a rear portion thereof, the motor housing having an elongated tube extending from a front portion thereof, the elongated tube having an open free end;

a broom attachment comprised of a head portion, the head portion having an upper surface and a lower surface, a plurality of bristles extending downwardly from the lower surface;

a clamp assembly comprised of a pair of clamping members dimensioned for coupling with the elongated tube of the leaf blower inwardly of the open free end thereof, each clamping member having a tab extending upwardly from upper ends thereof, each tab having a threaded aperture therethrough, a thumbscrew extending through the threaded apertures of the tabs for securement of the pair of clamping members to the elongated tube, lower ends of the pair of clamping members having a cross member extending therebetween, the cross member having a downwardly extending central portion; and a pivot assembly comprised of a plate member secured to the upper surface of the head portion of the broom attachment, the plate member having an upwardly extending central portion, a T-shaped stem extending upwardly from the upwardly extending central portion to rotatably couple with the downwardly extending central portion of the cross member of the clamp assembly, the upwardly extending central portion having a plurality of sockets formed in an upper surface thereof surrounding a shaft of the T-shaped stem, a plurality of ball bearings positioned within the plurality of sockets to facilitate rotation of the pivot assembly relative to the clamp assembly.

* * * * *